United States Patent [19]

Ebert

[11] 4,164,642

[45] Aug. 14, 1979

[54] RADIANT-HOT AIR HEATER

[76] Inventor: Edward A. Ebert, 203 Huxley Dr., Snyder, N.Y. 14226

[21] Appl. No.: 752,610

[22] Filed: Dec. 20, 1976

[51] Int. Cl.[2] ..... H05B 1/02; H01H 37/46; H01H 37/52

[52] U.S. Cl. ..... 219/358; 219/347; 219/349; 219/354; 219/449; 219/461; 219/512

[58] Field of Search ..... 219/342, 347, 358, 377, 219/448, 449, 411, 374, 504, 461, 454, 460, 343, 354, 512; 81/35; 34/4; 250/504

[56] References Cited

U.S. PATENT DOCUMENTS

| | | | |
|---|---|---|---|
| 881,017 | 3/1908 | Morse | 219/342 |
| 1,344,282 | 6/1920 | Wassell | 219/459 |
| 1,979,471 | 11/1934 | Knopp | 219/449 |
| 2,091,746 | 8/1937 | Wiley | 219/474 |
| 2,239,957 | 4/1941 | Genda | 219/462 |
| 2,313,492 | 3/1943 | Lobstein | 219/449 |
| 2,508,357 | 5/1950 | Ames | 219/461 |
| 2,668,364 | 2/1954 | Colton | 34/4 |
| 2,775,677 | 12/1956 | Schuetze | 219/445 |
| 2,789,200 | 4/1957 | Ebert | 219/364 |
| 2,860,225 | 11/1958 | Steen | 99/389 |
| 3,152,242 | 10/1964 | DeMott | 219/347 |
| 3,433,949 | 3/1969 | Truhan | 250/504 |
| 3,544,765 | 1/1968 | Kuster | 219/347 |
| 3,604,894 | 9/1971 | Milligan | 219/347 |
| 3,989,926 | 11/1976 | Yoshizawa et al. | 219/358 |

*Primary Examiner*—Roy N. Envall, Jr.
*Assistant Examiner*—Bernard Roskoski

[57] ABSTRACT

A device for heating an article up to a selected controlled temperature by irradiation of infrared rays upon the article of both longer and shorter wave lengths simultaneously as well as by conventional hot air. The infrared radiation evolves from an electrical generator behind a foraminious or perforate sheet forming a second radiation source of infrared rays of longer wave length than that of the generator through its absorption of the shorter rays from the generator while its perforations allow direct rays from the generator to pass through. The second radiator or perforate sheet is also used to control electrical current to the generator by its expansion and contraction to limit the generator's highest temperature while motivated air flows through the generator and the openings in the perforate sheet and being heated thereby flows on, aiding the radiation to heat the article. In other forms a reflector is used to return unobstructed rays back to the article or a pair of generator radiators are placed in opposed relationship.

18 Claims, 11 Drawing Figures

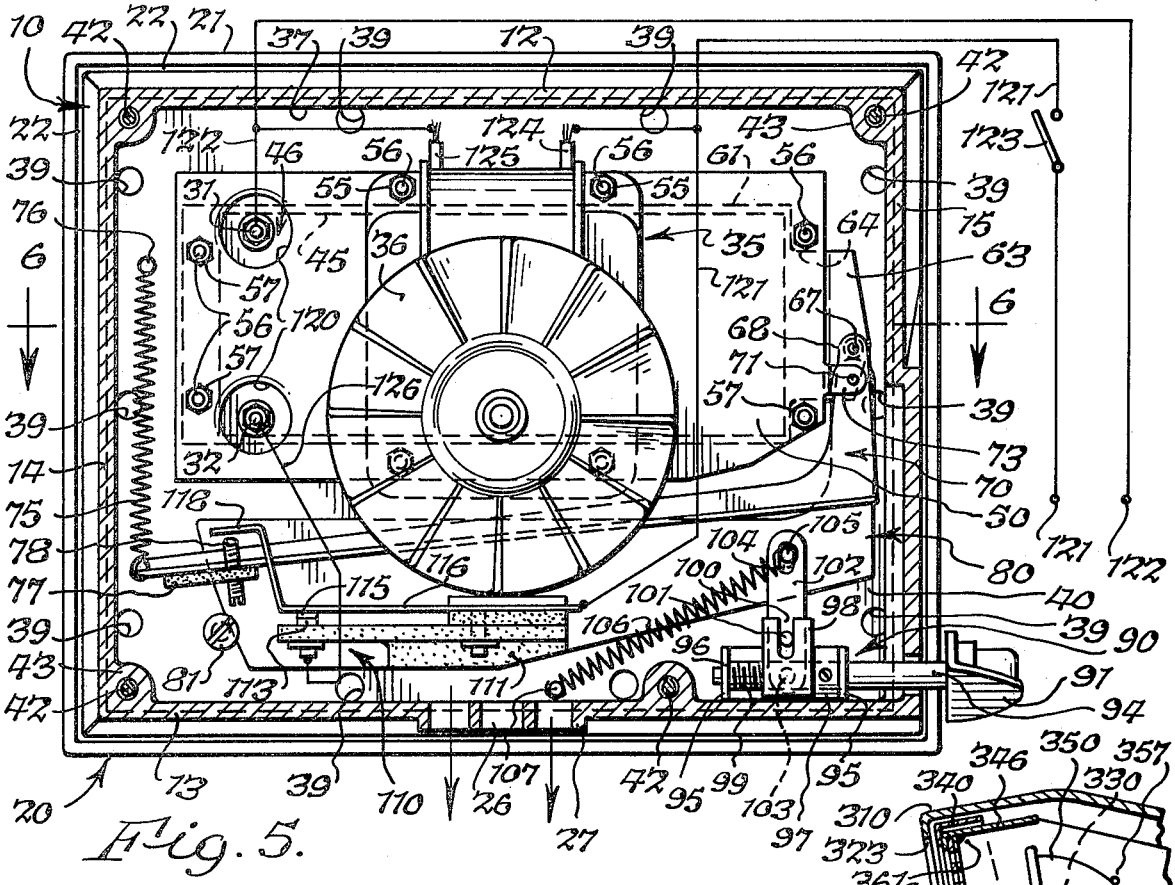
Fig. 5.
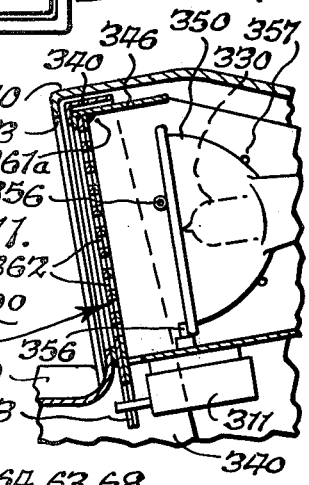
Fig. 11.
Fig. 6.
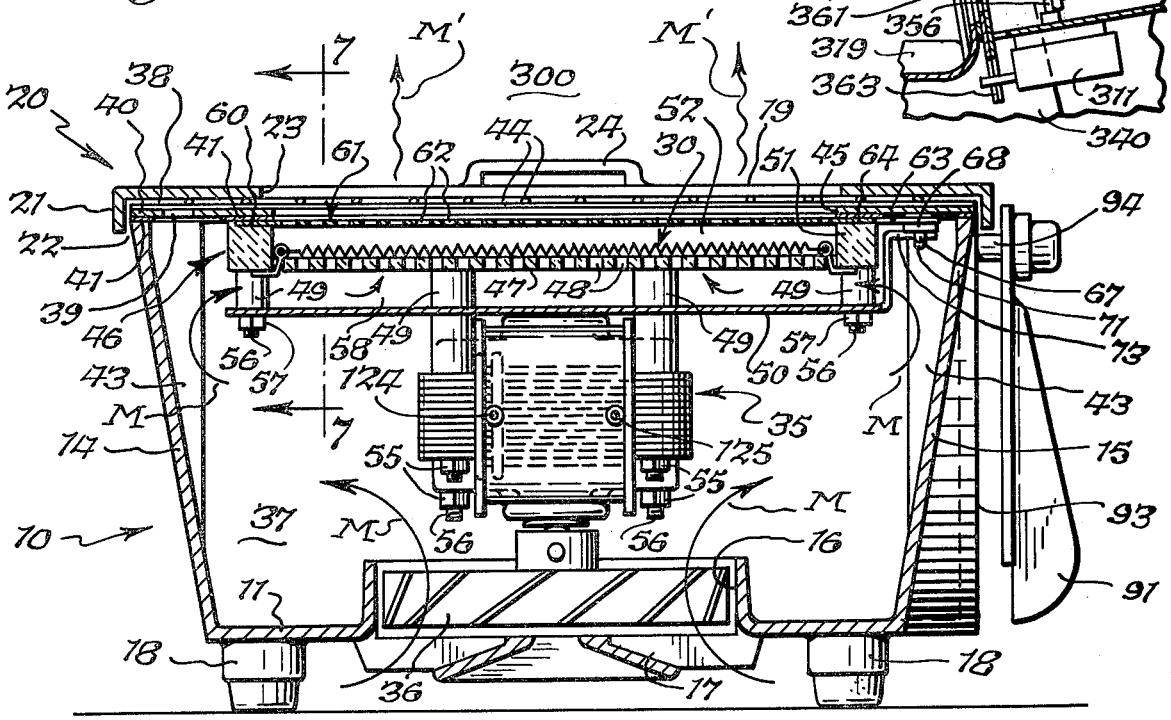

RADIANT-HOT AIR HEATER

BACKGROUND OF THE INVENTION

This invention relates to an improved method and apparatus for heating articles up to a limited temperature as fast as possible, consistent with the lack of scorching and damage to the finish of the article and then to cool the article back to the ambient room temperature. The opthalmic profession in particular has use for such a device in fitting of thermoplastic eyeglass frames to the head of an individual person, each being a customized fit.

The background of the opthalmic use shows many devices using heat of conduction, convection and radiation and includes patents in my name such as:

U.S. Pat. Nos.

2,789,200 issued Apr. 16, 1957, 3,816,705 issued June 11, 1974, 3,932,114 issued Jan. 13, 1976

Allowed application Ser. No. 589,200, filed June 23, 1975, now U.S. Pat. No. 4,052,593.

No matter what manner or method is used to accomplish heating it will usually be found to also have disadvantages as well as advantages. As for instance, with heat of conduction, contact with heated particles leaves impressions on the surface of the article, sometimes with particles themselves embedded in the article. With heat of convection; as in a liquid immersion type, the liquid residue must be wiped and removed. Again with convectional air heating, transfer of heat is quite slow but the article stays clean and needs no further treatment.

When an article is irradiated with infrared rays its color and surface texture effect its absorption of heat energy. Also in this case the wave length of the rays determines how much energy is absorbed, reflected, or passes through that particular article. To expound on this critical area that this invention is concerned with, the following tabulation will make things clear to compare the range of wave length radiation.

| Source | Microns 0–2 | Microns 2–6 | Microns 6–20 | % of radiant energy absorbed by a typical white surface |
|---|---|---|---|---|
| 2500° K. (4073° F.) | 60% | 35% | 5% | 30% |
| 1000° K. (1341° F.) | 5% | 65% | 30% | 70% |
| 700° K. (800° F.) | 5% | 45% | 50% | 85% |
| 600° K. (621° F.) | — | 35% | 65% | 90% |

The above table information was taken from Bulletin PE-70-Corning Industrial Radiant Heaters-Corning Glass Works, Corning, N.Y. This source indicates that in the 0–2 micron column most products absorb little of this energy. In the 2–6 micron column most products absorb 60% of this energy. In the 6–20 micron column most products absorb 90% of this energy.

It becomes obvious that even though a lot more energy is radiated at say 2500° K. a lot less energy is absorbed, and while at 600° K. a lot less energy is radiated, a lot more energy is absorbed. These facts taken with the color and surface sensitivity of articles tell use that again it is clear that we have advantages and disadvantages in each particular range we operate in.

This invention uses a novel means to convert high energy short wave length radiation heating one or more radiators, each radiating at a different wave length.

Since temperature dictates the frequency a body will radiate at, the invention proposes the use of thin perforate or foraminous sheets each absorbing some radiation on its imperforate areas from a primary source but letting primary radiation pass through their perforate areas, thus delivering two or more frequency ranges of radiation to the article being heated.

When more than one perforate radiator is used, the perforate areas and imperforate areas are positioned so that primary radiation heats the first radiator. The primary radiation that passes through its perforations heats the second radiator while both primary source radiation and first radiator source radiation passes through the perforations of the second radiator toward the article. Thus in this instance, three frequencies of radiation hit the article.

The perforate radiators might be 0.015" of an inch thick and because of the material removed from the perforate area they will be the mass equivalent of a sheet only 0.008" of an inch thick. Another example is: if the solid area is 20% with the hole area being 80% and with a wall thickness of 0.017", the equivalent mass would be an imperforate wall thickness of only 0.0034". This small mass heats and cools very fast.

The invention takes advantage of the fast expansion and contraction of this form of radiator to act as a sensor to control the current supplied to the infrared source generator, to maintain a constant energy output.

By placing all these parts in close proximity to each other a thin compact efficient unit is assemblied which allows placing the article very close to the heating sources.

By addition of a flow of air through this unit the additional advantage of convection heating is obtained with the bonus of the cooling of the sensor for close, small differential control of the generator's output.

It is, therefore, a prime object of this invention to heat an article with rays of radiation of more than a single wave length range because of the variable acceptability of each article to a particular frequency ray.

Another object of the invention is to have a device that is capable of radiating both far infrared and near infrared and if desired a band or bands of those rays in between.

Further relating to color it is an object to radiate more than one frequency range to make the device more color blind and to accept and heat articles in a wide color range in a more uniform time and faster.

Another object is the use of a single infrared generator and subsequent converter radiators to generate a number of radiation frequency ranges, all activated from a prime infrared generator.

Still another object is to shield the eyes of the user from the intense and harmful shorter wave length radiation of the generator.

A further prime object is to use one of the perforate radiators as a sensor to control the current supply to the generator to limit its energy output.

Another object is to provide a generator, a radiator, a sensor and reflector mounting having the same area of output as the frontal area presented by the article to be heated, to provide an even distribution of radiation and prevent hot spots and loss of unused radiation beyond the article to be heated.

An object of importance is the provision of the generator, the radiators and the sensor all compactly close to each other and in close proximity to the article to be heated.

Another object includes the use of moving air passing through the generator, the radiators and the generator support to provide heated air to help heat the article.

A further object is to use a generator, radiator and sensor of small mass for fast heating and fast cooling of these parts.

A still further object is the use of perforate bimetalic material as a radiator and sensor for control of temperature.

SUMMARY

The embodiments of this radiant convection type heater comprise the use of a primary generator of infrared radiation of a short wave length, in turn energizing subsequent perforate radiators radiating at a succession of longer wave lengths and at the same time allowing all wave length radiation to pass to an article to be heated, while at the same time, air moving through the generator and radiators is heated by them and then heats the article. Temperature control of the maximum heat output is obtained by using one of the radiators as a sensor to regulate power to the generator. Multi-wavelength radiation builds in a color blindness to make the heater less selective in heating articles having a wide range of colors and finishes.

BRIEF DESCRIPTION OF THE DRAWINGS

This invention as well as further objects and features thereof, will be understood more clearly and fully from the following detailed description of the preferred embodiment, when read in conjunction with the accompanying drawings in which:

FIG. 5 is a horizontal sectional view taken along line 5—5, FIG. 1; looking upwardly.

FIG. 6 is a vertical sectional view taken generally along line 6—6, FIG. 5;

FIG. 11 is a vertical sectional view similar to that in FIG. 9 wherein a perforate radiator made of bimetalic material is used.

GENERAL OPERATION

Figure 3:
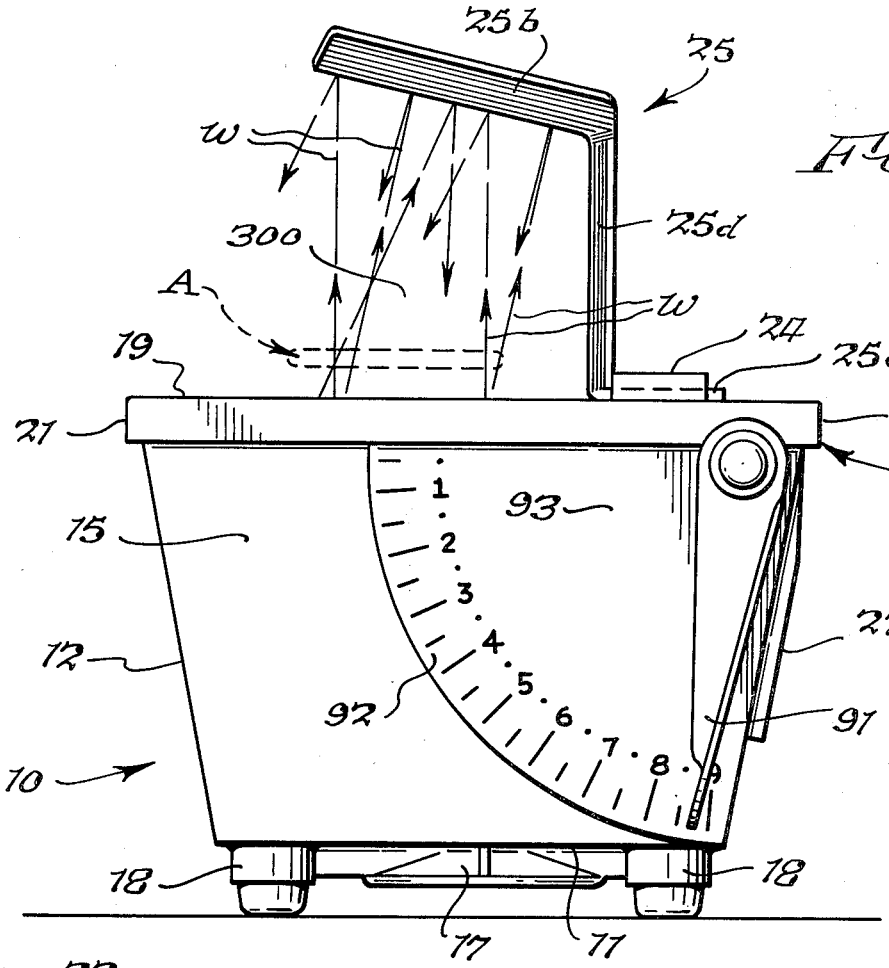
FIG. 3 is a right side elevation of FIG. 1.
Figure 4:
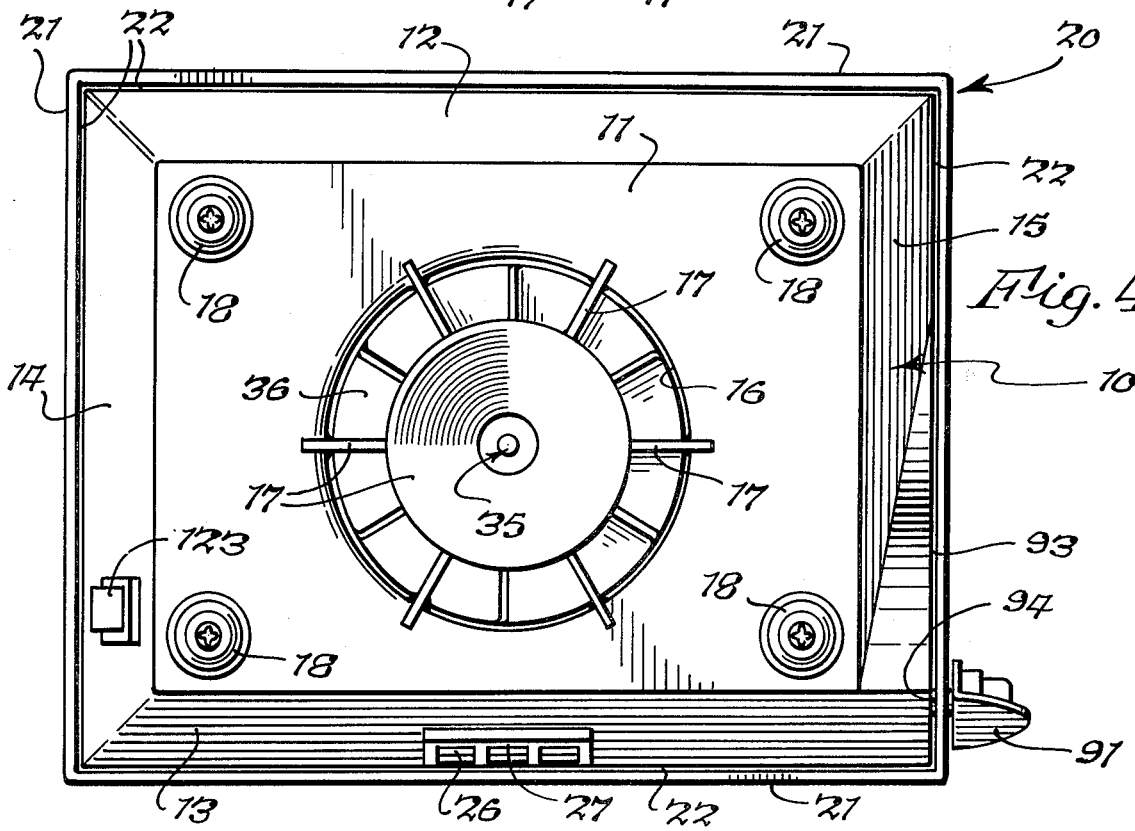
FIG. 4 is a bottom plan of FIG. 2.

As will be seen in FIG. 3 an article A is held in position over the secondary radiator 61 as seen in FIG. 6, which is heated by an electric infrared generator 30 so that radiation from both, impinge upon the lower side of article A. Rays that pass by or through the article can be reflected down upon the upper side of article A by reflector 25.

Secondary radiator 61 expands as it heats to allow spring 75 (FIG. 5) to rotate lever 70 clockwise and adjustment screw 78 mounted thereon will engage extension 118 of a spring finger 116 to separate the electrical contacts 113, 115 and open the circuit to the generator 30.

Looking again at FIG. 6 it can be seen that the fan motor 35, powering fan wheel 36 pressurizes the air inside of the housing 10, causing air to flow through the generator 30, radiator 61 and out of opening 45 in support plate 40 and window opening 23 of cover 19 toward the object or article A to heat it. This ambient temperature air is cool in relation to the generator 30 and radiator 61 causing it to shrink and again close the contacts 113, 115 and again energize and cause the generator 30 to send out heat and energy.

Low mass in the generator 30 and radiator 61 allows fast heating as well as cooling by the motivated air plus the high ratio of level arm 70 in opening and closing the contacts 113, 115.

DETAILED DESCRIPTION

The housing 10 having a bottom wall 11, a front wall 12, a rear wall 13, a left side wall 14 and a right side wall 15 is closed at its top by a cover member 20. Bottom wall 11 is provided with an inlet tube opening 16 which is protected by a guard 17 across its entrance and by four props 18 to support the bottom wall 11 and guard 17 above any surface it rests upon. The cover member 20 has a flat table like surface 19 which has a depending peripheral wall 21 which surrounds all side walls 12, 13, 14 and 15 of the housing 10 with a slight clearance 22, the purpose of which will later be revealed.

Cover member 20 is provided with a port opening or radiation window 23 out of which the heating energy of this device is delivered. To one side of opening 23 is a bracket member 24 which provides disengageable holding means for a reclaim reflector 25, which returns waste rays W back to the article. The rear wall 13 has port opening 26 for exit of cooling air through its jetted grill 27. The cover member 20 and its top wall 19 cover a heating generator 30 and all of its attendant parts in addition to a motor 35 which powers a tubeaxial fan wheel 36. The fan wheel 36 cooperates with the inlet tube opening 16 when in operation to draw air into the interior 37 of the housing 10 and pressurizes it.

A support plate 40 rests upon a thermal gasket 41 resting upon the upper edges of the side walls 12, 13, 14 and 15 and by means of the fastening screws 42 threaded into bosses 43 which are part of the side walls 12, 13, 14 and 15 hold the cover member 20 and the support plate 40 on to the housing 10.

Interposed between the cover top wall 19 and the support plate 40 is a grid work 44 protecting a port opening 45 generally matching the outline of the port opening or window 23 in the cover also serving as a spacer between 19 and 40. Also matching the outline of the port openings 23 and 45 is a ceramic or equivalent heat resistant, electrical insulating generator mount 46 having a bottom 47 wall with perforations 48. Extending from the bottom are spacing bosses 49 to support a generator reflector 50, providing an air space between the wall 47 and the reflector 50. The main body of the generator mount 46 comprise side walls 51 which enclose a space 52 and generally outline the port openings 23 and 45.

Studs 56 having their upper ends suitably fastened to the support plate 40 depend downwardly through openings in the generator mount 46 and the nuts 57 are used to draw the generator mount 46 up against the gasket 41 of the support plate 40.

A recess 60 in the upper face of the generator mount 46 receives a radiator 61 which may be of thin metal or equivalent material. Perforations 62 in this radiator 61 might be of a size and number so that 50% is solid and 50% is open. This proportion would block one half of the heat rays and would pass one half of the heat rays shining through it. Radiator 61 as seen in FIGS. 5 and 6 has at its right end an extension 63. (See FIG. 5) This extension passes through an opening 64 through the right upper side of the generator mount 46, which is through elongation of the recess 60.

The extension 63 of the radiator 61 has a pin 67 which pivotly connects to the short arm 68 of a long actuator lever 70, which is pivoted to a stationary pivot pin 71 fixed to the support plate 40 forming a fulcrum for the actuator lever 70.

This lever 70 lays against an adjusting lever 80 which in turn lays against the support plate 40. A large headed retaining screw 81 movably retains the left end of lever 80 while the right end is pivotly held onto the pivot pin 71 by a holding tab 73 which bent up from the reflector 50 at the pivot pin 71 and which holds the actuator lever up against the adjusting lever 80 and both up against support plate 40 for swinging movement about their pivot pin 71. The right end of lever 70 is biased by a tension spring 75 whose other end is connected to pin 76 fastened to support plate 40.

Actuator lever 70 mounts an insulator 77 which carries an adjustment screw 78.

The adjusting lever 80 can be rotated about its pivot 71 by means of a regulator mechanism 90 shown in FIG. 5 wherein a pointer arm 91 swinging in an arc passes marked increments 92 on a dial 93 clearly shown in FIG. 3. Pointer arm 91 is fixed to shaft 94 rotatably mounted in the U shaped bracket having bearing arms 95. A shoulder 96 and a collar 97 prevent endwise movement of the shaft 94 in the bracket arms 95.

A nut member 98 threads onto the threaded portion 99 of shaft 94 and has a bifurcated portion forming a slot 100 in which a pin 101 can slide. This pin 101 depends from an arm 102 which is pivoted on the support plate 40 at 103 about which it can swing. The other end of arm 102 is slotted at 104 to receive the pin 105 fixed to the adjusting lever 80. Pin 105 and thereby adjusting lever 80 is biased to the left as seen in FIG. 5 by tension spring 106 which hooks onto a pin fastened to support plate 40.

Adjusting lever 80 carries an electrical switch 110, comprising an insulated body portion 111 which carries a stationary contact 113 and a movable contact 115 on a spring finger 116, suitably mounted on the insulated body portion 111. An extension 118 of the spring finger 116 is designed to be engaged at times by the aforementioned screw 78 on the actuator lever 70 to open the contacts 113 and 115 and at other times allow them to spring together and to close and conduct current.

The reflector 50 has enlarged openings 120 to provide access of wiring to the generator 30 terminals 31 and 32 mounted in insulated relationship to the heat generator mount 46.

Support of the fan motor 35 is accomplished by four of the studs 56 being made long enough to pass through the motor frame, to be retained by the nuts 55.

The support plate 40 is provided with openings 39 which allows pressurized air from the interior 37 of the housing 10 to flow into the space 38 between the member 20 and the support plate 40 and then to the room by way of the port opening or by way of the clearance 22 around member 20 and the housing 10. This arrangement effectively prevents the conduction of heat to the cover member 20 leaving it at ambient room temperature and comfortable to the touch.

Electric current of suitable voltage may be supplied to the two lines 121 and 122. Line 121 is provided with an on-off switch 123 and it connects to a motor lead 124 and the spring finger 116 carrying the movable contact 115. Line 122 connects to another motor lead 125 and also connects to the heating generator 30 at terminal 31. The other generator 30 terminal 32 connects by line 126 to the stationary contact 113.

OPERATION

To put the device into operation the pointer 91 is set to the temperature required and the switch 123 is put into closed position. Electric current then flows through the switch 123, line 121 to motor lead 124 and to spring finger 116. Current flows through motor 35 winding to lead 125 connected to the other side of the line 122 completing the circuit and setting fan wheel 36 into motion to pressurize the interior 37 of the housing 10 above ambient room pressure.

At the same time current also flows through spring finger 116 through closed contacts 115, 113 to line 126 to terminal 32 of heating coil generator 30 to terminal 31 to the other side of the line 122, thus energizing generator 30.

Figure 7:
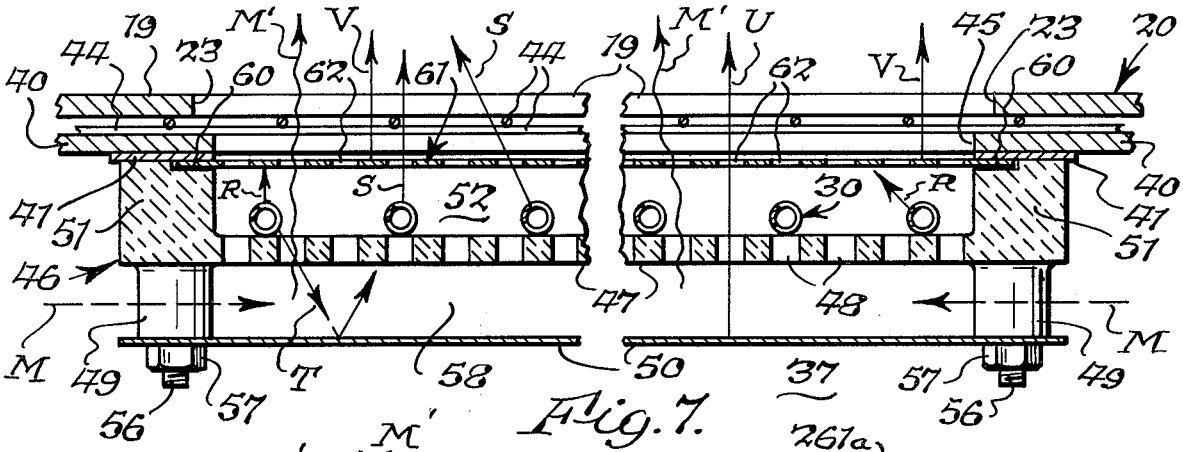
FIG. 7 is a fragmentary enlargement section taken along line 7—7, FIG. 6.

Upon energization of the generator 30 infrared radiation occurs and as can more easily be seen in FIG. 7 some direct radiation R impinges on the under side of radiator 61. This radiator 61 in this instance is a very thin membrane like, perforate sheet of metal having its top and bottom sides developed into a dull mat finish, which is compatable to maximum absorption as well as maximum radiation of infrared energy.

As will be seen in FIG. 7 this direct radiation R will be absorbed causing radiator 61 to then itself radiate heat in the form of secondary rays V. As will be further seen other direct radiation S will pass through the perforations 62 in the radiator 61. Still other radiation T from the bottom side will either engage the generator mount bottom wall 47 or pass through its perforations 48. That which passes through will be relfected back to the wall 47 or through it back to the generator. Some reflected radiation U will pass through both perforations 48 and 62 up the article A being heated, as seen in FIGS. 3 and 7.

Motivated air M from the interior 37 of the housing 10 enters around the peripheral edge of the reflector 50 into the space 58 between the wall 47 of the generator mount 46 and the reflector and passes upwardly through the perforations 48 into the space 52 where generator 30 is located. This air is heated by generator 30 as it then passes up through perforations 62 in the radiator 61 while being further heated. It then immerges out through the port window 45 of the support plate and the port window 23 of the cover member 20 up toward the article held above the parts. Radiation direct, secondary and reflected, immerge with the heated air M all combined to accomplish heating of the article.

Since the wave length of radiation is determined by temperature the direct rays S will be the hottest and of shortest wave length, the secondary rays V will be cooler than rays S and of longer wave length, while reflected rays U will be of the longest wavelength.

It must then be seen that article A when positioned, in the space 300 as in FIG. 3 will receive infrared radiation from at least three different sources and frequencies while also being heated by heated air in motion.

Figure 1:
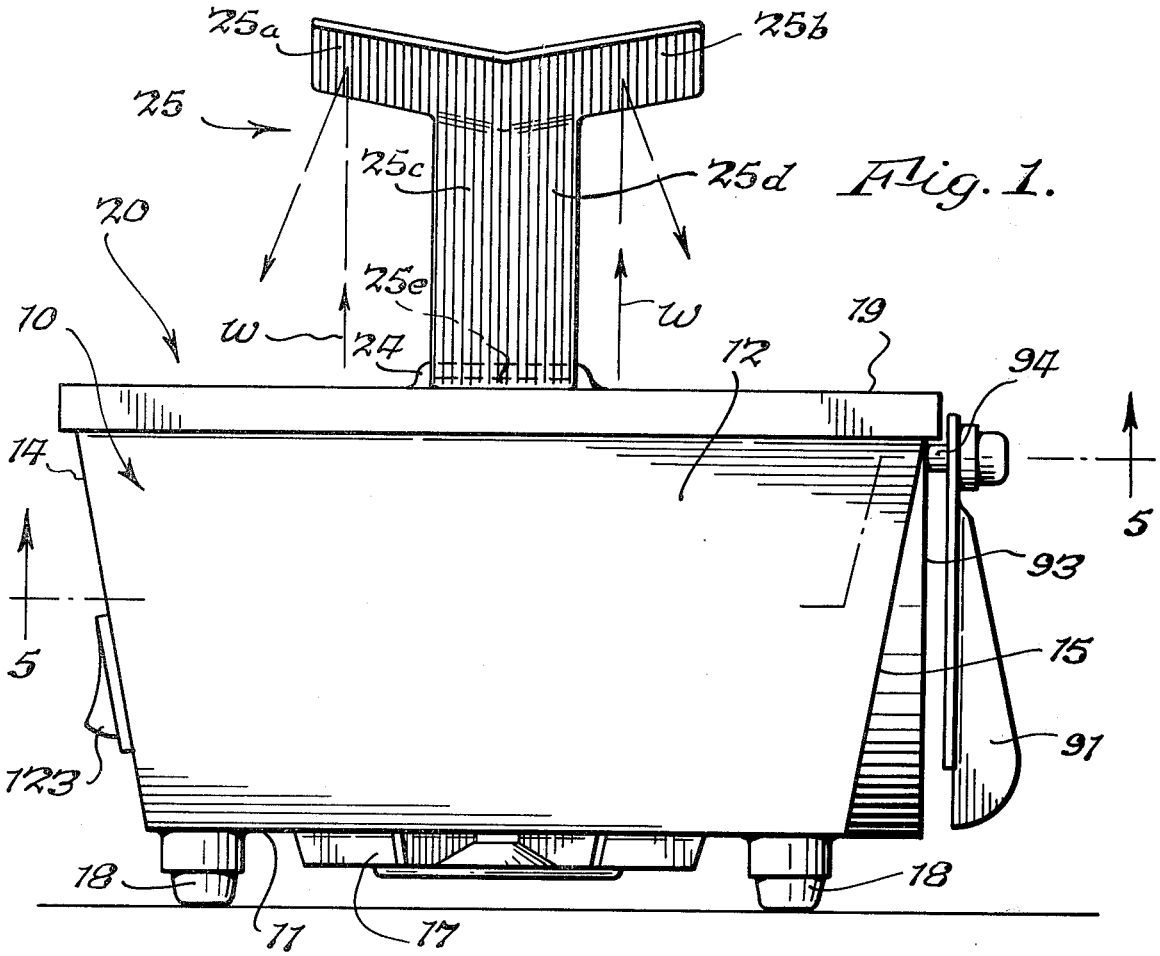
FIG. 1 is a front side elevation.
Figure 2:
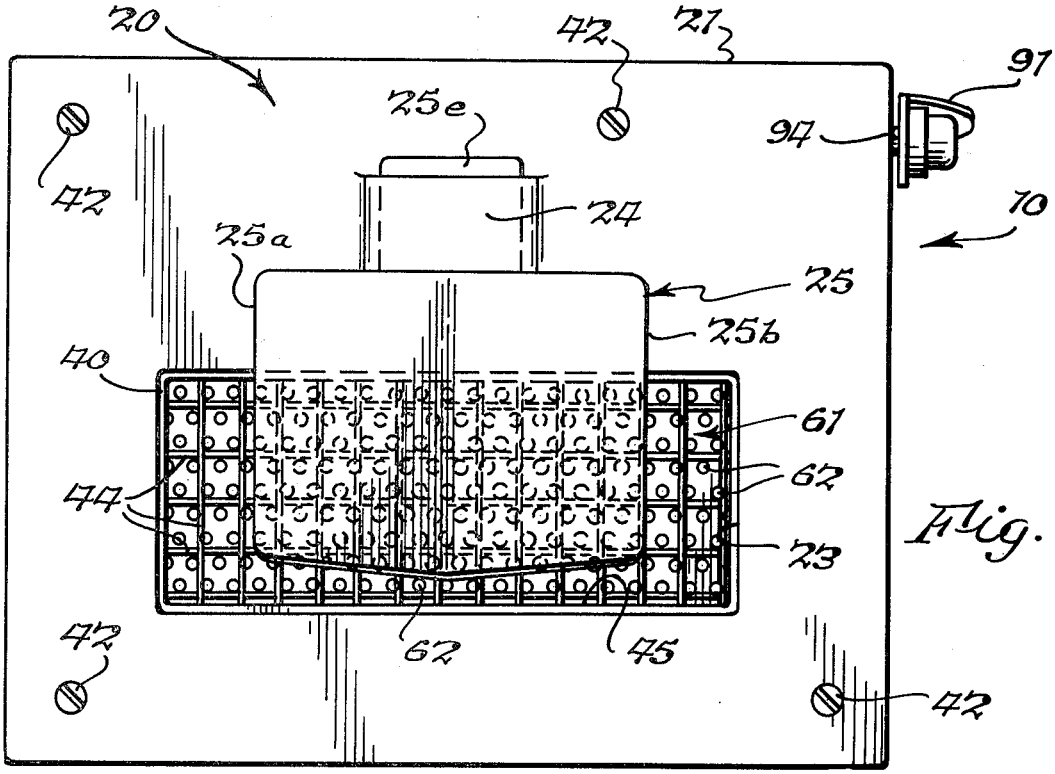
FIG. 2 is a top plan thereof.

As seen in FIGS. 1, 2, and 3, a removable reflector is shown in place. It comprises a pedestal portion having diverging reflectors 25*c*, 25*d* and having a bottom foot 25*e* which can be slid into the strap bracket 24 part of cover member 20. At its upper end the pedestal has set at an angle to the horizontal the reflectors 25*a* and 25*b*.

Selection of the reflector angles has been made to accommodate a reflector which gives the smallest size and the least interference in using the heating device, enhancing by its complete removability.

As seen in FIGS. 1 and 3 rays of radiation W projecting out of the port opening 23 are reflected back to the article A for not only quicker heating but for conservation of energy.

Most articles A will not block all of the radiation projecting out of port 23 and if opthalmic eye frames are being heated even the lenses do not block out the radiant energy since they are transparent to them. Also the reflecting surfaces 25*a*, 25*b*, 25*c*, 25*d* are lenticulated to diffuse the reflected rays. This with the diverging surfaces preclude a ray being reflected back to its source of origination. In some cases converging surfaces might be desirable.

As mentioned earlier the perforate radiator 61 is used to control the output of energy. To accomplish this the radiation 61 is held in the recess 60 of the generator mount 46. As seen in FIGS. 5 and 6 the left end of the radiator is held from movement at this end by the studs 56 passing through two holes in the radiator 61. The other extension end 63 projects out and beyond the generator mount 46. By its connection through pin 67 to lever 68 of actuator lever 70 which is biased by spring 75 connected to pin 76, the radiator is placed under considerable tension. The ratio of the lever arm being something like 25:1 at the adjustment screw 78 tip to the pivot point 71 or fulcrum to the pin connection 67.

It will be realized that with this amplification, small expansions and contractions of the radiator 61 under heating and cooling can effect the opening and closing of the contacts 113, 115 in very short cycles and large amplitudes.

Upon expansion of radiator 61, the contact 115 is pulled away from the contact 113, against the tension of the spring finger 116. The reverse, takes place upon cooling and contraction of radiator 61.

Thus very close and accurate control of the energy output of the generator 30 is maintained. If a higher temperature is required for a certain article the pointer arm 91 is swung down to a higher setting, this moving the adjusting lever 80 up and away from the screw tip 78 which allows the generator 30 to be on longer, to a higher temperature, more energy output and is then maintained at this level.

Figure 8:
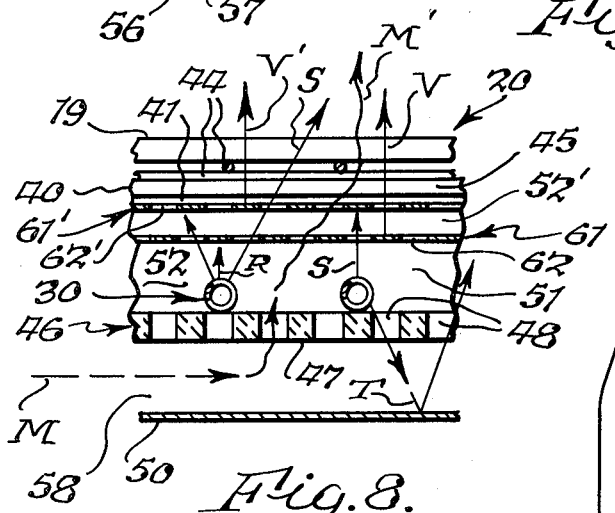
FIG. 8 is another enlarged fragmentary sectional view showing two radiators plus the generator.

A modified form of the invention is shown in FIG. 8, wherein an additional radiator 61' having perforations 62' is used. This additional radiator 61' is placed in spaced relationship with the space 52' over the first radiator 61 and provides still another radiation wave length V' in addition to those generated by the generator 30 and the first radiator 61.

Since radiator 61' receives some S radiation from the generator 30 and some secondary radiation V from radiator 61 its frequency of radiation will be in a different range from that of the generator 30 or that of the radiator 61 and thus its radiation V' is different, ie of a longer wave length. Three ranges of course broadens and makes the total radiation less specific to color selection.

Figure 10:
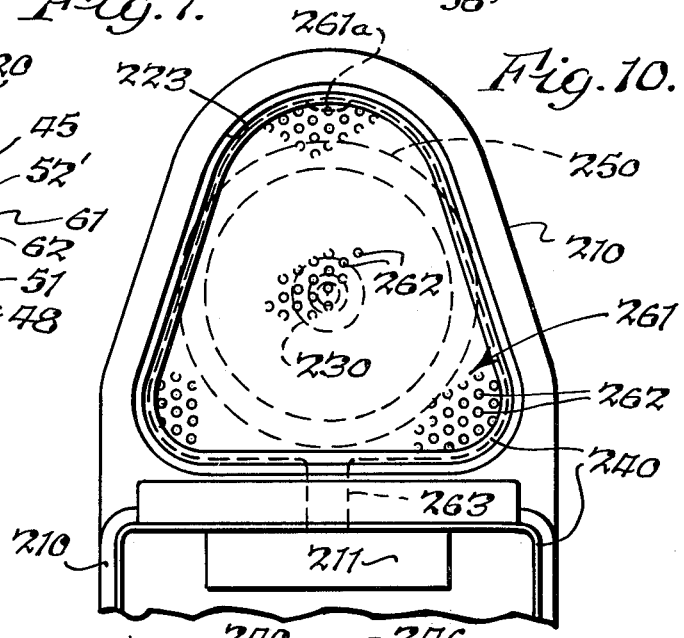
FIG. 10 is a vertical section taken along line 10—10 of FIG. 9.
Figure 9:
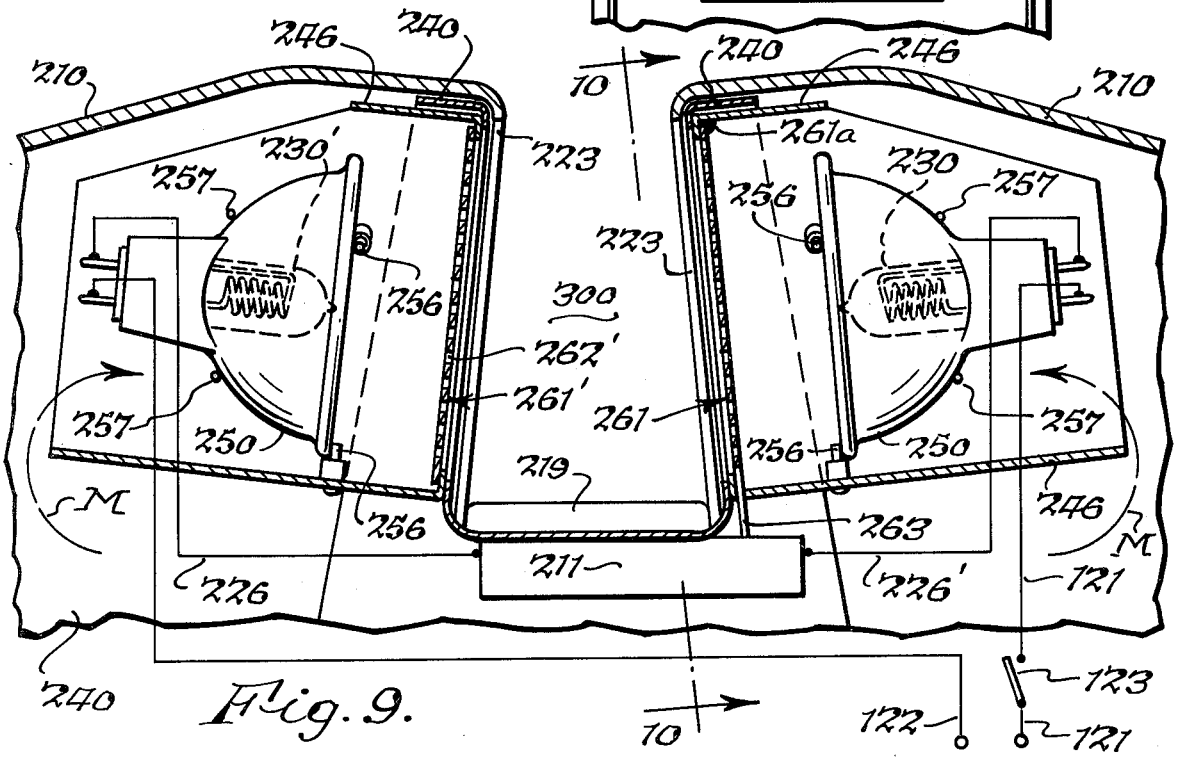
FIG. 9 is a vertical sectional elevation through a modified form of the invention using Tungsten Halogen Lamps as infrared generators.

Another modification of the invention is illustrated in the FIGS. 9 and 10. In this form the infrared radiation is generated by a pair of Tungsten Halogen Lamps 230, 230' in opposed relationship providing a space 300 where an article may be radiated on two of its sides. A housing 210 having openings or radiation windows 223 may be provided which holds pressurized ambient air similarly to that just described in the first disclosure. A support means 240 mounted in the housing provides support for the Tungsten Halogen Lamps 230, 230', their reflectors 250 and opposed radiators 261 and 261' having perforations 262, and 262', all held in a generator mount 246.

Pins 256 position the front face of the reflectors 250 while spring hair pin shaped retainers 257 resiliently retain the reflectors 250 against the pins 256.

At the bottom of the space 300 as insulated cover 219 may be used to support articles or may be used to prevent their being marred.

The radiator 261 is fastened at 261*a* to mount 246 at its upper edge and has an extension 263 which forms a connection to a suitable controller or switch 211 in a circuit similar to that just explained.

When switch 123 is closed, current will flow through line 121 to one terminal of the lamp 230, to the other terminal and line 226' to switch 211, line 226 to one terminal of another lamp 230', to the other terminal to the other side of the line 122. In this circuit the two lamps 230 are in series with each other but could just as well be connected in parallel.

In this form of the invention as in the first, two ranges of radiation are caused to heat an article held in the space 300. Here the heat ranges can be in much higher temperatures since Tungstan Halogen Lamp reaches temperatures above 2500° Kelvin or 4073° Farenheit. Some of the shorter wave radiation from the generators 230, 230' passes through the perforations 626, 261' to directly heat an article, while some of this radiation impinges upon the radiators 261, 261' and being absorbed heats it, whereupon radiators 261, 261', radiates at a longer wave length to heat an article placed in space 300.

There is need for only one control 211 in this set up because both lamp generators 230 are in series and thus responsive to the control of only one heat sensor radiator 261, being anchored to the mount 246 at 261*a*. The sensor here senses the heat radiation from its own generator 230 as well as heat from the opposite generator 230'.

In FIG. 11, is shown a similar Tungsten Halogen Lamp generator 330 with a reflector 350, mounting pins 356 and retainers 357. A generator mount 346 held in the support means 340 is positioned and held in a housing 310 having a window opening 323.

The radiator 361 fastened to mount 346 and having perforations 362 in this instance is made of bimetalic material that distorts under heat to move the extension 363 to actuate the controller 311 to turn the generator 330 on and off and control its output of energy. As seen in FIG. 11 the radiation passes out of the opening 323 of the housing 310 into the space 300 which may also have an opposed generator radiator as illustrated in modification of FIGS. 9 and 10.

In the illustrations of FIGS. 9, 10 and 11 the perforate radiators 261, 361 serve to protect the operator's eyes from the intense radiation of the high temperature generators 230 and 330, since the operator can only look at the radiators 261, 261' and 361 in an oblique manner and never directly at the intensely heated generators. Also only a certain percentage of direct radiation passes through the radiators cutting even that radiation down one half if the radiator has 50% closed and 50% open area.

From the foregoing illustrations and explanations is can be seen that the apparatus will heat an article by radiation and convection and do it fast, efficiently and with less selectivity for the color of the article. It will protect the user from the higher temperature radiation and it will bring the temperature of the article back down to ambient room temperature.

The terms and expressions which have been employed are used as terms of description and not of limitation, and there is no intention, in the use of such terms and expressions, of excluding any equivalents of the features shown and described, or portions thereof, it being recognized that various modifications are possible within the scope of the invention claimed.

What is claimed is:

1. A radiant hot air heater comprising:

a primary radiant heat generator;

a perforate secondary radiator in close relationship to said generator;

switch means responsive to said secondary radiator but controlling said primary generator;

wherein said primary generator heats said secondary radiator to cause it to emit radiation at a longer wavelength than radiation emitted from said generator and whereby both longer and shorter wavelength emission can radiate an article alongside of said secondary radiator;

a generator mount for support of said generator, said generator mount having an open top, side walls and a perforate bottom wall, and;

a generator reflector outside of but facing said perforate bottom wall;

whereby radiation from said bottom wall and radiation from said primary generator passing through said perforations in said bottom wall are reflected back toward said bottom wall.

2. A radiant hot air heater comprising:

a primary radiant heat generator;

a perforate secondary radiator in close relationship to said generator;

switch means responsive to said secondary radiator but controlling said primary generator;

wherein said primary generator heats said secondary radiator to cause it to emit radiation at a longer wavelength than radiation emitted from said generator and whereby both longer and shorter wavelength emission can radiate an article alongside of said secondary radiator;

a generator mount for support of said generator, said generator mount having an open top, side walls and a perforate bottom wall;

said primary generator and said secondary radiator and said generator mount and said switch means all being supported on a support member;

said support member having a port opening generally matching the outline of said primary generator and said secondary radiator;

a housing closed at its top by said support member and provided with air pressurizing means;

whereby air can flow through said generator mount, said primary generator, said perforate secondary radiator and said port opening toward said article, and;

a cover having an opening approximately the same as said port opening in said support member;

whereby said cover lays over said support member but is separated there from by an air space having connection from the interior of said housing to the outside so that air will flow in said air space to cool said cover from the heat of said generator and said secondary radiator.

3. A radiant hot air heater comprising:

a primary radiant heat generator;

a perforate secondary radiator in close relationship to said generator;

switch means responsive to said secondary radiator but controlling said primary generator;

wherein said primary generator heats said secondary radiator to cause it to emit radiation at a longer wavelength then radiation emitted from said generator and whereby both longer and shorter wavelength emission can radiate an article alongside of said secondary radiator; and a reflector facing said article and said secondary perforate radiation, to cause radiation not absorbed or eclipsed by said article to return to said article and said primary generator.

4. A radiant hot air heater comprising;

a primary radiant heat generator, emitting predominantly short wavelength radiation;

a perforate secondary radiator, emitting predominantly long wavelength radiation, and;

a support member for carrying said primary heat generator and said perforate secondary radiator and a switch means, said switch means being responsive to thermal movement of said secondary radiator relative to said support member to control current to said primary generator;

whereby said primary generator heats said secondary radiator to cause it to emit radiation at a longer wavelength than radiation emitted from said primary generator and whereby both longer and shorter wavelength emission can radiate an article alongside of said perforate secondary radiator, said perforate secondary radiator being comprised of a thin metal membrane having low mass and low heat inertia and having a thickness range of approximately 0.005" to 0.020".

5. A radiant hot air heater comprising;

a support member;

a primary heat generator mounted relative to said support member for emitting predominantly short wavelength radiation;

means for supplying energy for heating said primary generator;

a perforate secondary radiator mounted relative to said support member for emitting predominantly long wavelength radiation;

said primary generator being mounted proximate said secondary radiator to heat said perforate secondary radiator to cause it to emit radiation at a longer wavelength than radiation emitted from said primary generator so that the emission from both of said primary generator and said perforate secondary radiator can radiate an article;

and switch means physically connected between said suport member and said perforate secondary radiator, said switch means being normally closed and being actuated to an open condition by movement of said secondary radiator relative to said support member as a result of expansion of said secondary radiator resulting from heating thereof by said primary generator, said switch means returning to said normally closed condition in response to the cooling of said secondary radiator;

whereby said means for supplying energy are selectively caused to supply energy for heating said primary generator.

6. A radiant hot air heater as set forth in claim 5 wherein;

said perforate secondary radiator is comprised of a bi-metal.

7. A radiant hot air heater as set forth in claim 5 wherein;

said primary radiant heat generator is comprised of a Halogen type lamp.

8. A radiant hot air heater as set forth in claim 5 further comprising;

a generator mount held by said support member.

9. A radiant hot air heater as set forth in claim 8 wherein;

said generator mount has an open top, side walls and a perforate bottom wall.

10. A radiant hot air heater as set forth in claim 9 wherein;

said perforate secondary radiator closes over said open top of said generator mount.

11. A radiant hot air heater as set forth in claim 5 wherein;

said support member has a port opening generally matching the outline of said primary generator and said perforate secondary radiator.

12. A radiant hot air heater as set forth in claim 5 wherein;

said perforate radiator includes an open area defined by perforations therein, and wherein;

the open area of said perforations in said perforate secondary radiator is the means by which the ratio of amount of long to short wavelength emission is selected.

13. A radiant hot air heater as set forth in claim 5 further comprising;

a tertiary radiator, heated by said primary generator and said perforate secondary radiator whereby;

said tertiary radiator emits radiation at a wavelength still longer than said long wavelength radiation and said short wavelength radiation toward said article.

14. A radiant hot air heater as set forth in claim 5 further comprising;

a second hot air heater comprising;

a second primary heat generator and;

a second perforate secondary radiator;

wherein said support member carries said second primary heat generator and said second preforate secondary radiator of said second hot air heater in an opposed facing relationship with said first mentioned hot air heater for placement of said article therebetween to heat more than one side of said article, and;

wherein both of said primary heat generators are controlled by a single said switch means.

15. A radiant hot air heater as set forth in claim 14 wherein;

said opposed first mentioned and second primary heat generators comprise a first and a second Halogen type lamp.

16. A radiant hot air heater as set forth in claim 15 wherein;

the said opposed radiant hot air heater relationship of said first mentioned heater and said second heater will not allow direct line of sight viewing of either of said primary generators, through said perforations of either of said first or second secondary radiators.

17. A heater as set forth in claim 1:

wherein said generator reflector acts as a baffle to direct air from around its perifery to said perforations in said bottom wall.

18. A heater as set forth in claim 3 wherein, said reflector is smaller than the area of radiation from said secondary radiator.

* * * * *